United States Patent [19]

Handal

[11] 4,300,438

[45] Nov. 17, 1981

[54] RESINOUS DRUMSTICK

[76] Inventor: Richard A. Handal, 2904 Harris Ave., Wheaton, Md. 20902

[21] Appl. No.: 182,634

[22] Filed: Aug. 29, 1980

[51] Int. Cl.[3] ..... G10D 13/02
[52] U.S. Cl. ..... 84/422 S
[58] Field of Search ..... 84/422

[56] References Cited

U.S. PATENT DOCUMENTS 3,147,660 9/1964 Brilhart ..... 84/422 S
3,489,052 1/1970 Colyer et al. ..... 84/422 S

*Primary Examiner*—Lawrence R. Franklin

[57] ABSTRACT

A drumstick made with cotton fabric impregnated with phenolic resin, molded into a rod of suitable thickness under high temperature and pressure and then machined into shape.

5 Claims, 2 Drawing Figures

RESINOUS DRUMSTICK

The present invention relates to a drumstick of the type that is commonly used to strike various percussion instruments such as drums, cymbals and the like.

Normally, the typical drumstick was made of hickory wood to have the qualities of comfortable "feel", flexibility and resiliency, as well as absorbability. Hickory hard wood is preferred to avoid changes in temperature and humidity of the drumstick. Because the wooden drumstics are difficult to match with regard to weight, balance and tonal qualities, and because they do not last very long on repeated use, experts in this art area have replaced them with drumsticks made with glass fiber or nylon coated with various types of resin, such as in U.S. Pat. Nos. 3,489,052 and 4,047,460.

The use of nylon or glass fabric does supply strength but fails to provide for resilience, flexibility and shock absorbability. These characteristics can only be obtained by choosing a component that is cellulosic in composition. Woven cotton fabric is such a cellulosic composition as is found in wood. Not only will it impart resilience and flexibility, but it is also well suited for thorough impregnation with the desired resin to yield shock absorbability.

The limitations which reside in the drumsticks of the cited patents are overcome by the present invention.

It is the principal object of this invention to provide a resinous drumstick which has improved durability, weight, stability, and better resilience, flexibility and percussion absorbability than any drumstick disclosure of the prior art.

It is another object of the present invention to provide a drumstick that has the ability to be used on any type of percussion instrument so as always to deliver a clearer drum sound and cymbal sound.

It is another object of this invention to yield an excellent tone even when struck on a drum rim and still be sufficiently resilient to avoid breakage to either the drumstick or the rim.

A further object is to employ the use of inexpensive materials and standard manufacturing processes in making this novel drumstick Details of the foregoing objects of the invention as well as the other objects thereof are set forth in the following specification and illustrated in the accompanying drawing comprising a part thereof.

Figure 1:
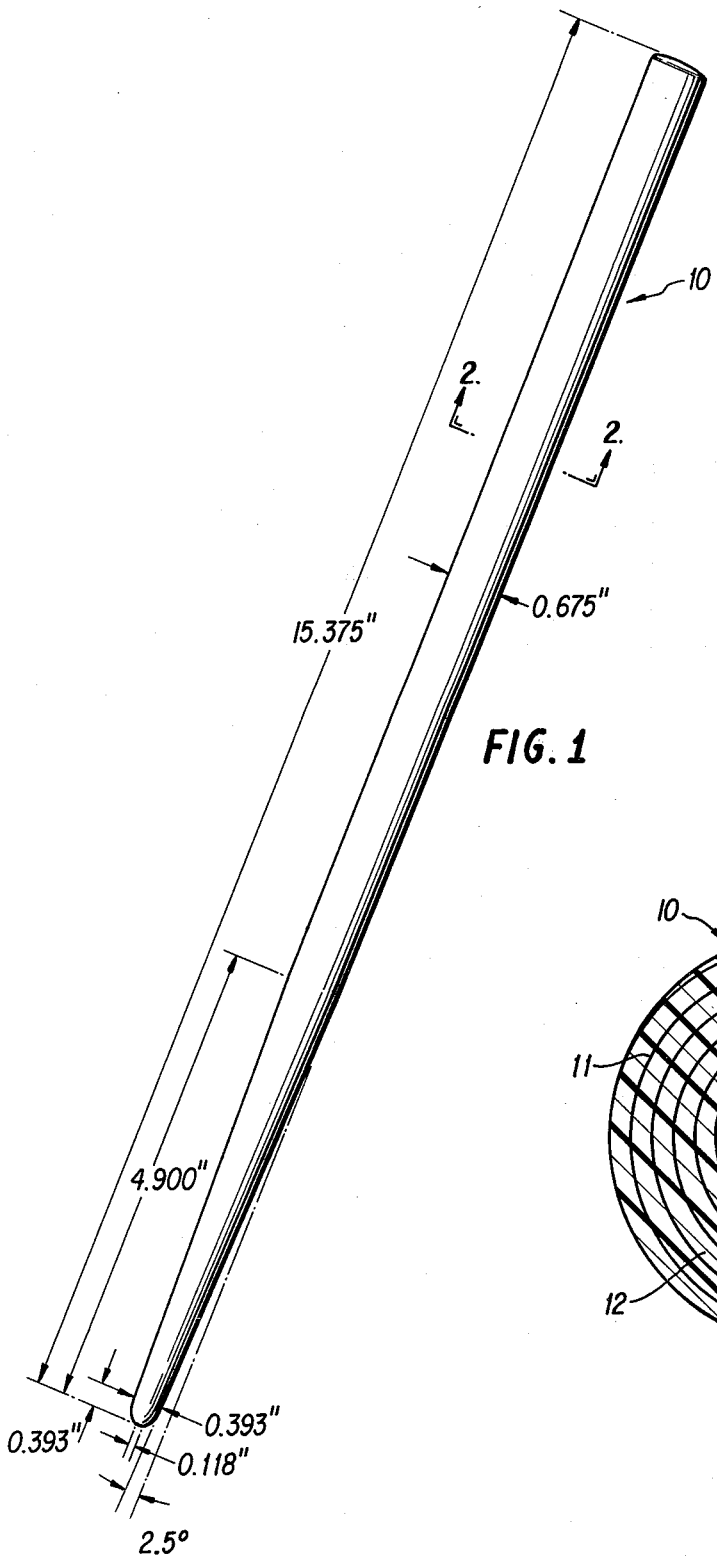
Figure 2:
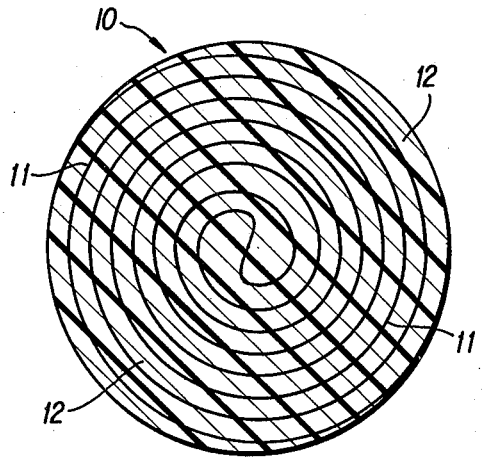

FIG. 1 is a perspective view of a drumstick embodying the features of the present invention; and FIG. 2 is a cross-sectional view of the drumstick shaft as seen along 2—2 of FIG. 1.

Referring to FIG. 1, there is shown a resinous drumstick 10 embodying the principles of the present invention. A cellulose fabric, such as woven cotton fabric 11, is immersed in a bath of heat hardening organic solvent formaldehyde condensate, preferably in a butanol solution, in a 1:1 ratio of cotton fabric to resin 12, content. It is exposed to heat to evaporate the solvent and gathered on a roller. The impregnated fabric is then cut into sheets. A sheet of such impregnated fabric is rolled into a cylindrical shape as shown in FIG. 2, and placed into a suitably shaped mold so as to form a solid rod under high heat and pressure. It is colored brown. However, it can be colored any other hue if desired. The resultant rod is machined so that the percussion striking end is graded approximately $2\frac{1}{2}°$ toward the body of the rod in order to obtain the desired tapered percussion end.

In FIG. 1 the dimensions of the drumstick include a $15\frac{5}{8}''$ of approximate length with the tapered length being approximately 4 9/10 " resulting in an angular taper of $2\frac{1}{2}°$ as shown. The tip length is equal to 0.393" with the butt end of the tip measuring about 0.118".

If it be desired to have a headed tip for percussion, it can be so machined as to yield a headed drumstick. Although phenolic resin is preferred, any one of the following could be used. Such resins include the acrylates, the styrenes, the polyvinyl chlorides, the polyamides, the polyolefins, the vinyls, the fluorocarbons, the polycarbonates, the cellulosic acetates and most other thermosetting resins.

The preferred cellulose fabric is one that is woven and the resin is phenolic. An unexpected benefit of this combination is that not only does the drumstick so made have good resilience but it also has a highly polished appearance. It also gives the user a comfortable feeling in hand when in use. The reason for this comfortable feeling is that the vibrations of the percussion strikes are absorbed by the instant drumstick. This enables the user to use such a drumstick over a longer period than customary.

The glass and nylon fabric used in the drumsticks of the prior art do not absorb these vibrations in the manner that the cotton fabric of the instant drumstic does. It is probably the combination of the cotton fabric and the phenolic resin which impregnates it that synergistically is able to absorb the shock waves resulting from striking the drumstic on the rim, or the top of the percussion instrument. Another advantage of the instant drumstick is that it is not slippery and fits smoothly into the hand during use. A non-headed drumstick is preferred since it gives better resonance on higher tensional drums. When using phenolic resin, it is easily possible to color the drumstick from its ordinarily brown shade to any desired colored shade, other than brown.

Because of the excellent absorbability of the instant drumstick, it is possible to hit the cymbals as hard as desired with feeling only a bare minimum of the resultant vibrations in the hand of the user.

As to durability, the instant drumsticks are practically indestructible and could easily last a lifetime. Also not to be overlooked, is the fact that it can be economically produced since both materials are inexpensive and ordinary economical manufacturing methods are available.

While the invention has been described and illustrated in its preferred embodiment, it should be understood that the invention is not limited to the precise details herein illustrated and described since the same may be carried out in other ways falling within the scope of the invention as illustrated and described.

What is claimed is:

1. A resinous drumstrick comprising a rolled woven cotton fabric impregnated with phenolic resin.

2. The drumstick of claim 1 wherein the color is other than brown.

3. The drumstick of claim 1 wherein the color is brown.

4. The drumstick of claim 1 wherein the drumstick is headed at its percussion end.

5. The drumstick of claim 1 wherein the percussion end is tapered $2\frac{1}{2}$ degrees from said end towards the body of the drumstick.

* * * * *